United States Patent [19]

Russell et al.

[11] Patent Number: 4,956,823

[45] Date of Patent: Sep. 11, 1990

[54] SIGNAL TRANSMITTERS

[76] Inventors: Michael K. Russell, Lynworth House, 54 High Street, Prestbury, Cheltenham, England; Anthony W. Russell, Drachlaw, Turriff, Aberdeenshire, Scotland

[21] Appl. No.: 286,299

[22] Filed: Dec. 19, 1988

[30] Foreign Application Priority Data

Jan. 19, 1988 [GB] United Kingdom ..... 8801072

[51] Int. Cl.[5] ..... G01V 1/00

[52] U.S. Cl. ..... 367/84

[58] Field of Search ..... 340/853, 861; 367/81, 367/83, 84; 137/499

[56] References Cited

U.S. PATENT DOCUMENTS

Re. 30,055 7/1979 Claycomb ..... 367/84

4,785,300 11/1988 Chin et al. ..... 340/861

*Primary Examiner*—Brian S. Steinberger

*Attorney, Agent, or Firm*—Young & Thompson

[57] ABSTRACT

A transmitter comprises an impeller assembly rotatable by a liquid flow, and an electrical generator having a stator and a rotor arranged to be driven by the impeller assembly. The impeller assembly comprises a main impeller portion and a secondary impeller portion angularly displaceable relative to one another about the axis of rotation of the impeller assembly in response to a change in load of the generator so as to vary the pressure drop across the rotating impeller assembly. Thus appropriate variation of the load of the generator may be used to control the impeller assembly in such a manner as to transmit pressure signals within the liquid flow. Such a transmitter is particularly suitable for transmitting measurement data to the surface from a measuring instrument at the end of a drill string within a borehole. Furthermore such a transmitter can be constructed so as to be readily retrievable without requiring withdrawal of the drill string from the borehole.

9 Claims, 2 Drawing Sheets

SIGNAL TRANSMITTERS

BACKGROUND OF THE INVENTION

This invention relates to signal transmitters for transmitting pressure signals within a flowing liquid, and is more particularly, but no exclusively, concerned with a down-hole transmitter for generating mud pulses in a so-called mud-pulse telemetry system.

It is well known to transmit measurement data from a measuring instrument at the end of a drill string within a borehole by generating pressure variations within the mud flow passing along the drill string and to retrieve the transmitted data by sensing such pressure variations at the surface. The data is transmitted in serial form using some mechanical means of modifying the mud flow in order to produce the necessary pressure variations. These mechanical devices require relatively high forces to operate them with the result that most commercial mud-pulse telemetry systems use either a hydraulic power source or a high power battery power source. The electrical power requirement of the measuring instrumentation is normally only a small fraction of that of the mechanical devices.

Furthermore most existing commercial mud-pulse telemetry systems make use of a mud throttle or valve located within a mechanical assembly attached in some way to the drill collar at the end of the drill string. The mud-pulse transmitter and the drill collar constitute an integrated flow system which must usually be assembled prior to lowering of the drill string in the borehole. For this reason most mud-pulse transmitters are not retrievable or replaceable without withdrawing the whole drill string from the borehole.

It is an object of the invention to provide an improved signal transmitter for transmitting pressure signals within a flowing liquid which provides particular advantages when used in a mud-pulse telemetry system.

SUMMARY OF THE INVENTION

According to the present invention there is provided a signal transmitter for transmitting pressure signals within a flowing liquid, the transmitter comprising an impeller assembly rotatable by the liquid flow, and an electrical generator comprising a stator and a rotor arranged to be driven by the impeller assembly, wherein the impeller assembly comprises a main impeller portion and a secondary impeller portion which are angularly displaceable relative to one another about the axis of rotation of the impeller assembly in response to a required change in the load of the generator so as to vary the pressure drop across the rotating impeller assembly, whereby appropriate variation of the load of the generator may be used to control the impeller assembly in such a manner as to transmit pressure signals within the flowing liquid.

Such a transmitter does not require the use of a separate hydraulic or battery power source and may be adapted to supply the power requirement of associated measuring instrumentation. Furthermore the transmitter may be constructed so that it is readily retrievable or replaceable from within a borehole without requiring withdrawal of an associated drill string.

In a preferred embodiment the main impeller portion includes main blades rotatable about said axis by the liquid flow, and the secondary impeller portion includes secondary blades located axially downstream of the main blades and rotatable with the main blades about said axis, the pressure drop across the rotating impeller assembly being dependent on the angular orientation of the secondary blades relative to the main blades about said axis.

Furthermore it is preferred that the impeller assembly includes an impeller shaft bearing a magnet assembly which forms the rotor and is surrounded by the stator.

Advantageously the impeller shaft comprises two coaxial shaft portions constituting respectively parts of the main impeller portion and the secondary impeller portion, one of the shaft portions being tubular and the other shaft portion being journalled within said one shaft portion so as to be rotatable with said one shaft portion and angularly displaceable within, and relative to, said one shaft portion.

Conveniently said one shaft portion constitutes part of the main impeller portion, and said other shaft portion constitutes part of the secondary impeller portion.

It is also convenient if said other shaft portion bears the magnet assembly constituting the rotor so that the rotor is rotatable with said other shaft portion and angularly displaceable within, and relative to, said one shaft portion.

In most applications it is preferred that the stator comprises a first stator winding for supplying electrical power to a circuit, and a second stator winding to which a variable load is connectable.

The transmitter may further comprise means for varying the load applied to the stator of the generator.

The transmitter may include a casing surrounding the generator, and spacing fins extending outwardly from the casing.

BRIEF DESCRIPTION OF THE DRAWINGS

In order that the invention may be more fully understood, a mud-pulse telemetry transmitter in accordance with the invention will now be described, by way of example, with reference to the accompanying drawings, in which.

DETAILED DESCRIPTION OF THE DRAWINGS

Figure 1:
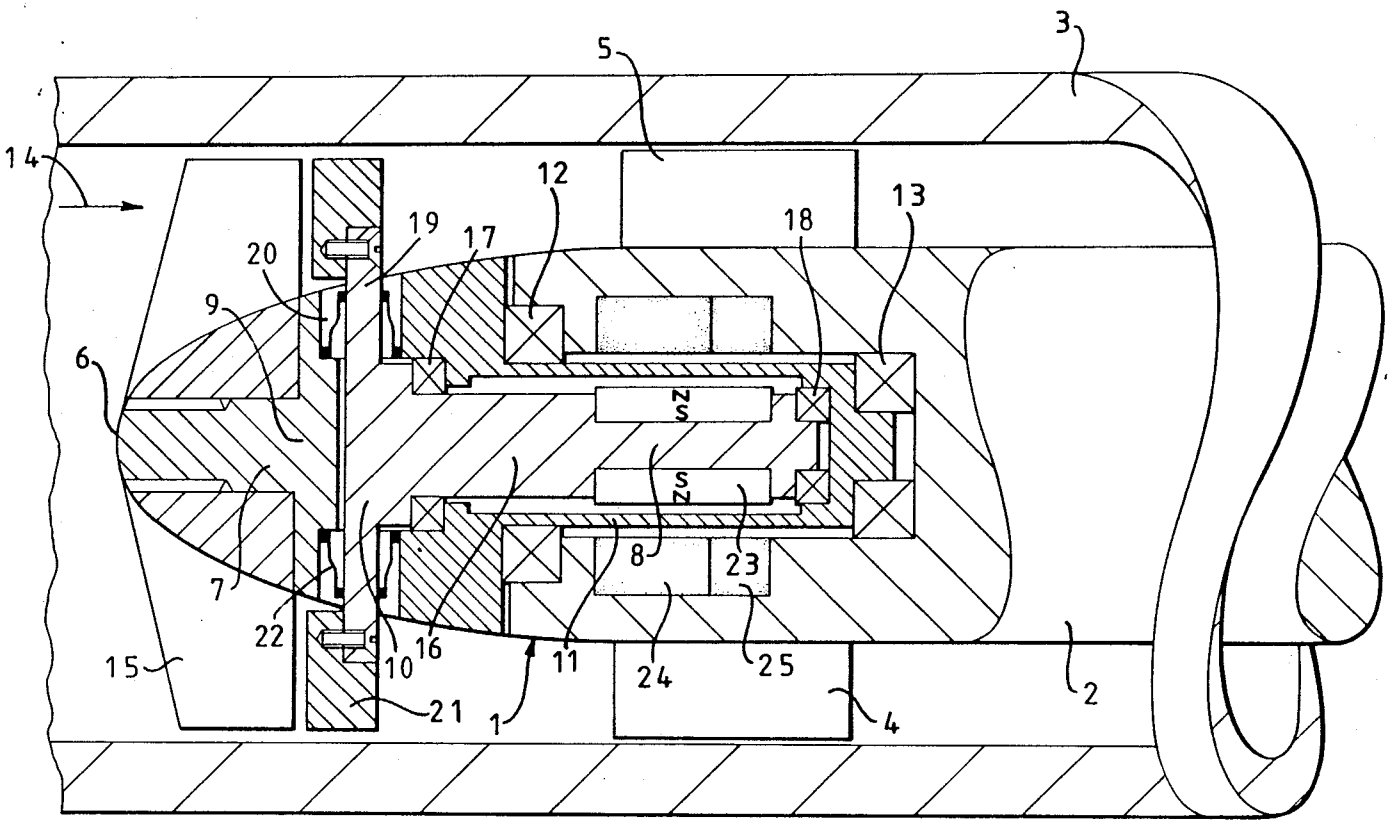
FIG. 1 is an axial section through the transmitter located within a drill collar.

Referring to FIG. 1, the signal transmitter 1 comprises a casing 2 positioned coaxially within a drill collar 3 forming part of a drill string within a borehole (not shown). The casing 2 is spaced radially from the inside wall of the drill collar 3 by two sets of spacing fins 4 and 5 extending outwardly from the casing 2. The casing 2 is axially located within the drill collar 3 by engagement of a conventional mule shoe and spacer bar assembly (not shown), although the axial location is not critical. The addition of a conventional overshot (not shown) on the nose 6 of the casing 2 would permit retrieval of the transmitter 1 along the drill string without requiring withdrawal of the complete drill string from the borehole.

The transmitter 1 comprises an impeller assembly 7 and an electrical generator 8 disposed within the casing 2. The impeller assembly 7 comprises a main impeller portion 9 and a secondary impeller portion 10. The main impeller portion 9 has a tubular shaft portion 11 carried by mud lubricated bearings 12 and 13 and rotatable by the mud flow in the direction of the arrow 14 acting on radial blades 15 on the main impeller portion 9. The secondary impeller portion 10 includes a shaft portion 16 coaxial with the shaft portion 11 and journalled within the shaft portion 11 by bearings 17 and 18 so as to be rotatable with the shaft portion 11 and angularly displaceable within, and relative to, the shaft portion.

The secondary impeller portion 10 is formed with two or more arms 19 which protrude through openings 20 in the main impeller portion 9 and which, are connected to an annular bladed member 21. The arms 19 are sealed to the main impeller portion 9 by elastomer seals 22 in such a way that the arms 19 have limited movement within the openings 20, and such that the shaft portion 16 is capable of limited angular displacement relative to the shaft portion 11. The sealed volume between the shaft portions 11 and 16 is filled with oil and, by virtue of the compliance of the elastomer seals 22, is pressure balanced with respect to the external mud pressure.

The shaft portion 16 of the secondary impeller portion 10 carries a magnet assembly 23 comprising a number of permanent magnets which form the rotor of the generator 8. The generator 8 also includes an annular stator surrounding the shaft portion 11 in the vicinity of the rotor and comprising two stator windings 24 and 25.

In operation of the signal transmitter 1 downhole the mud flow impacts on the blades 15 so as to rotate the main impeller portion 9, and consequently also the secondary impeller portion 10 carried thereby. If the stator electrical loads are low, the main impeller portion 9 and the secondary impeller portion 10 will rotate in alignment with relative movement between the two impeller portions being restrained by the elastomer seals 22.

Figure 2:
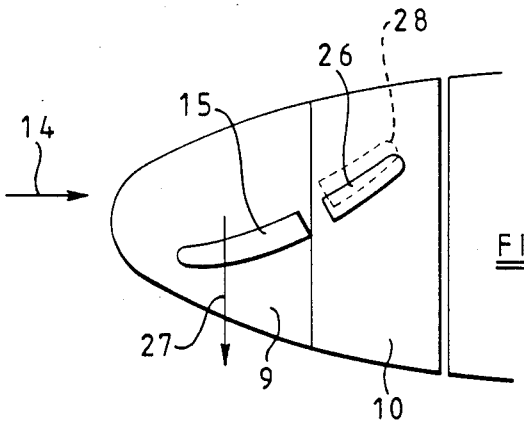
FIG. 2 is a diagram showing the impeller blades of the transmitter.

FIG. 2 shows the positional relationship between the blades 15 on the main impeller portion 9 and the blades 26 on the secondary impeller portion 10 in such a state, only one blade being shown in each case for the sake of clarity. It will be appreciated that the blades 15 and 26 will rotate in alignment in the direction of the arrow 27. If the generator load is increased, the torque required to drive the rotor will increase and this will cause the elastomer seal 22 to distort to enable the secondary impeller portion 10 to be angularly displaced by a small angle relative to the main impeller portion 9. This can be considered as being caused by slight braking of the secondary impeller portion 10 by the generator 8. The result of this will be that the blades 26 on the secondary impeller portion 10 will lag the blades 15 on the main impeller portion 9, as shown by the broken lines 28 in FIG. 2. The blade overlap will cause a throttling effect resulting in an increased pressure drop across the impeller assembly. Thus pressure variations can be generated in the mud flow by variation of the generator load.

Figure 3:
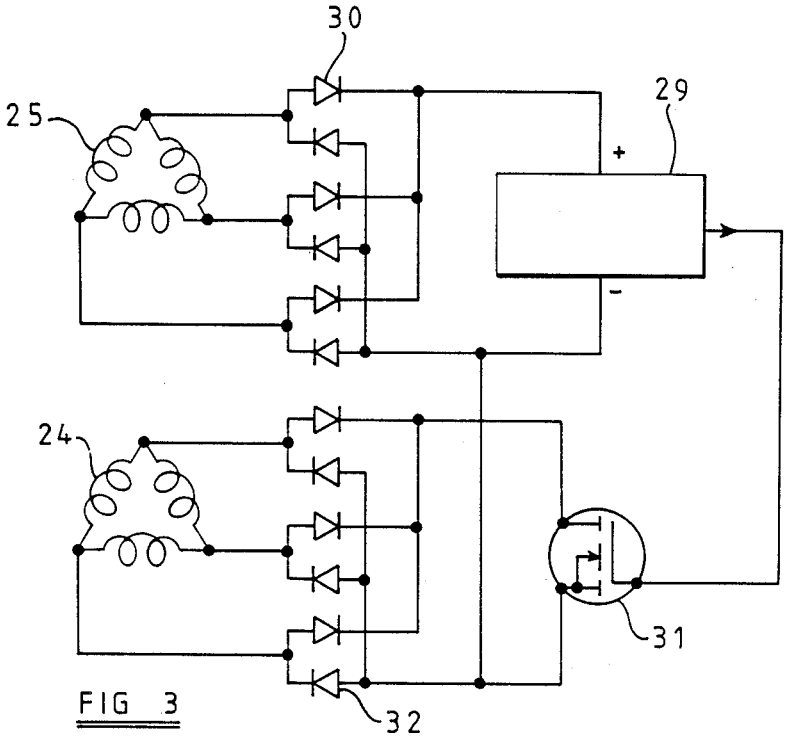
FIG. 3 is a circuit diagram of a control circuit forming part of the transmitter.

FIG. 3 shows the electrical connections to the two stator three phase generator 8. The first stator windings 25 are connected to probe circuitry 29 by way of a rectifier bridge 30 which rectifies the three phase voltage output of the windings 25. The probe circuitry works in conjunction with the particular measuring instrument or instruments being used and computes a pulse demand output signal corresponding to the required serial coding of the data to be transmitted. The pulse demand output signal operates a MOSFET switch which is connected to the first winding 24 by way of a rectifier bridge 32. When the switch 31 is closed by a suitable signal level from the probe circuitry 29 the rectified output of the first windings 24 is short circuited so as to cause the desired increase in loading of the generator and so as to increase the torque required to drive the rotor.

In a modification of the above-described transmitter, instead of relying solely on the elastomer seals 22 for aligning the blades 15 and 26, a rotary stop and preloaded spring arrangement are provided for this purpose.

In a further modification a torque multiplying gearbox (step down) is provided between the magnet assembly 23 and the shaft portion 16 so as to increase the braking torque exerted on short circuiting of the first stator windings 24 so as to give a greater relative deflection between the blades 15 and 26.

We claim:

1. A signal transmitter for transmitting pressure signals within a flowing liquid, the transmitter comprising an impeller assembly rotatable by the liquid flow about an axis of rotation and an electrical generator having a stator and a rotor arranged to be driven by said impeller assembly, wherein said impeller assembly comprises a main impeller portion and a secondary impeller portion angularly displaceable relative to one another about said axis of rotation of said impeller assembly in response to a change in the load of said generator so as to vary the pressure drop across said rotating impeller assembly, whereby appropriate variation of the load of said generator serves to control said impeller assembly in such a manner as to transmit pressure signals within the flowing liquid, said main impeller portion including main blades rotatable about said axis by the liquid flow, and said secondary impeller portion including secondary blades located axially downstream of said main blades and rotatable with said main blades about said axis, the pressure drop across said rotating impeller assembly being dependent on the angular orientation of said secondary blades relative to said main blades about said axis.

2. A signal transmitter for transmitting pressure signals within a flowing liquid, the transmitter comprising:

(a) an impeller assembly rotatable by the liquid flow about an axis of rotation, said impeller assembly comprising a main impeller portion including main blades and a secondary impeller portion including secondary blades located axially downstream of the main blades and rotatable with the main impeller portion about said axis of rotation, said main impeller portion and said secondary impeller portion being angularly displaceable relative to one another about said axis of rotation between two angular positions of said secondary blades relative to said main blades to vary the pressure drop across said rotating impeller assembly, (b) an electrical generator having a stator and a rotor, said rotor being driven by said rotating impeller assembly, and (c) electrical control circuitry connected to the stator of the electrical generator and operable, in response to a first level of input signal, to apply a first load to said generator which results in a first relative angular position of said secondary blades relative to said main blades, and, in response to a second level of input signal, to apply a second load to said generator which results in a second relative angular position of said secondary blades relative to said main blades, whereby variation of said input signal between said first and second levels results in variation of the pressure drop across said rotating impeller assembly in such a manner as to transmit pressure signals within the flowing liquid.

3. A signal transmitter according to claim 2, wherein said impeller assembly includes an impeller shaft bearing a magnet assembly which forms said rotor and is surrounded by said stator.

4. A signal transmitter according to claim 3, wherein said impeller shaft comprises two coaxial shaft portions constituting respectively parts of said main impeller portion and said secondary impeller portion, one of said shaft portions being tubular and the other of said shaft portions being journalled within said one shaft portion so as to be rotatable with said one shaft portion and angularly displaceable within, and relative to, said one shaft portion.

5. A signal transmitter according to claim 4, wherein said one shaft portion constitutes part of said main impeller portion, and said other shaft portion constitutes part of said secondary impeller portion.

6. A signal transmitter according to claim 5, wherein said other shaft portion bears said magnet assembly constituting said rotor so that said rotor is rotatable with said other shaft portion and angularly displaceable within, and relative to, said one shaft portion.

7. A signal transmitter according to claim 2, wherein said stator comprises first stator windings for supplying electrical power to a circuit, and second stator windings to which a variable load is connectable.

8. A signal transmitter according to claim 2, wherein a casing surrounds said generator, and spacing fins extend outwardly from said casing.

9. A signal transmitter according to claim 2, wherein an elastomer seal is provided between said main impeller portion and said secondary impeller portion to permit limited relative angular movement of said secondary impeller portion relative to said main impeller portion.

* * * * *